US010265233B2

(12) United States Patent
Wakabayashi et al.

(10) Patent No.: US 10,265,233 B2
(45) Date of Patent: Apr. 23, 2019

(54) INCUBATOR

(71) Applicant: ATOM MEDICAL CORPORATION, Bunkyo-ku, Tokyo (JP)

(72) Inventors: Keisuke Wakabayashi, Saitama (JP); Kenji Kobayashi, Saitama (JP); Masaaki Oohashi, Saitama (JP); Ichiro Matsubara, Tokyo (JP); Terumi Matsubara, Tokyo (JP)

(73) Assignee: ATOM MEDICAL CORPORATION, Tokyo (JP)

( * ) Notice: Subject to any disclaimer, the term of this patent is extended or adjusted under 35 U.S.C. 154(b) by 136 days.

(21) Appl. No.: 15/402,685

(22) Filed: Jan. 10, 2017

(65) Prior Publication Data

US 2017/0202720 A1 Jul. 20, 2017

(30) Foreign Application Priority Data

Jan. 20, 2016 (JP) ..... 2016-008752

(51) Int. Cl.
*A61G 11/00* (2006.01)

(52) U.S. Cl.
CPC ..... *A61G 11/009* (2013.01); *A61G 11/006* (2013.01)

(58) Field of Classification Search
CPC ..... A61G 11/00; A61G 11/001–11/009
See application file for complete search history.

(56) References Cited

U.S. PATENT DOCUMENTS 5,954,627 A 9/1999 Sekine et al.
2002/0017248 A1* 2/2002 Honma ..... A61G 11/00 119/311

FOREIGN PATENT DOCUMENTS

JP H10-248887 A 9/1998
JP 2002-028198 A 1/2002

OTHER PUBLICATIONS

Extended Search Report in corresponding European Application No. 16207147.6, dated Jun. 16, 2017, 6 pages.

* cited by examiner

*Primary Examiner* — Carrie R Dorna
(74) *Attorney, Agent, or Firm* — Brinks Gilson & Lione

(57) ABSTRACT

The present disclosure provides an incubator capable of enabling a user to easily and sufficiently perform a required operation inside an infant accommodation space of the incubator, since substantially the entire area of a hand insertion opening is actually opened when the user opens a service door and inserts their hand into the hand insertion opening. In the incubator, the hand insertion opening is configured so as to be capable of being opened and closed by the service door in a first state in which a first support frame member is attached to a peripheral wall section of the infant accommodation space, and the hand insertion opening is configured so as to be capable of functioning as an aperture window in a second state in which a second support frame member, a third support frame member, and an aperture window forming member are respectively attached to the peripheral wall section.

6 Claims, 11 Drawing Sheets

INCUBATOR

RELATED APPLICATIONS

This application claims priority under 35 U.S.C. § 119 to Japanese Patent Application No. 2016-008752 filed on Jan. 20, 2016, the entire content of which is hereby incorporated by reference.

BACKGROUND OF THE INVENTION

Technical Field

The present disclosure relates to an incubator including a hand insertion opening formed in a peripheral wall section of an infant accommodation space, a service door capable of closing the hand insertion opening, a support frame member capable of being attached to the peripheral wall section in order to retain the service door so as to allow swinging to and fro, and a latch mechanism capable of retaining the service door in a closed position to close the hand insertion opening.

Related Art

An incubator described in Japanese Patent Application Laid-Open (JP-A) No. H10-248887 (hereafter referred to as "the incubator of Patent Document 1") includes a hand insertion opening formed in a peripheral wall section of an infant accommodation space, a service window lid capable of closing the hand insertion opening, a service door that is attached to the service window lid so as to be capable of swinging to and fro so as to be capable of opening and closing a substantially central portion of the service window lid, and a latch lever capable of retaining the service door in a closed position to close the hand insertion opening. In the incubator of Patent Document 1, the service window can be changed to an aperture window by detaching the service window lid from the peripheral wall section and attaching an aperture window forming member to the hand insertion opening.

However, in the incubator of Patent Document 1, the surface area of the service door is approximately half the size of the surface area of the service window lid that is capable of closing the hand insertion opening. Thus, when a user has opened the service door and has inserted their hand through the hand insertion opening, an open portion of the hand insertion opening that is actually open only has a small surface area, such that it is difficult to easily and sufficiently perform a required operation inside an enclosure of the incubator.

SUMMARY OF THE INVENTION

The present disclosure effectively resolves the above-described issue relating to the incubator of Patent Document 1 using a comparatively simple configuration.

The present disclosure relates to an incubator including: a hand insertion opening formed in a peripheral wall section of an infant accommodation space, a service door capable of opening and closing substantially the entire hand insertion opening by swinging to and fro, a first support frame member that can be attached to the peripheral wall section to retain the service door so as to be capable of swinging to and fro, and a latch mechanism that can retain the service door in a closed position; and further comprising a second support frame member that can be attached to the peripheral wall section to support one end of an aperture window forming member capable of forming an aperture window, and a third support frame member that can support another end of the aperture window forming member. The hand insertion opening is configured to be opened and closed by the service door in a first state in which the first support frame member is attached to the peripheral wall section, and the hand insertion opening is configured to function as the aperture window in a second state in which the second support frame member, the third support frame member, and the aperture window forming member are respectively attached to the peripheral wall section. In this configuration, a surface area of the service door is substantially the same size as an area of the hand insertion opening formed in the peripheral wall section of the infant accommodation space. This enables a user to easily and sufficiently perform a required operation inside the infant accommodation space of the incubator, since substantially the entire area of the hand insertion opening is actually opened when the user opens the service door and inserts their hand into the hand insertion opening. Moreover, an operation to attach the aperture window forming mechanism to the peripheral wall section of the infant accommodation space is comparatively easy, exchanging the aperture window forming mechanism and the service door with each other is also comparatively easy, there is excellent wipeability and exchangeability when exchanging these components with each other, and the number of components can be comparatively reduced.

In a second aspect of the present disclosure, an axially supported portion of the service door is axially supported by the first support frame member so as to be capable of swinging, and when the peripheral wall section is viewed from substantially a front face in the closed state of the service door, the shape of a portion of the service door other than the axially supported portion is configured so as to be substantially the same shape as the hand insertion opening of the peripheral wall section. In this configuration, the service door can be made comparatively large, without the service door becoming any particular hindrance, or the appearance of the service door being particularly negatively affected. In a third aspect of the present disclosure, when the service door is viewed from substantially a front face in the closed state of the service door, a latch release knob and a latch hook of the latch mechanism are configured so as not to protrude from the service door. In this configuration, the latch release knob and the latch hook of the latch mechanism are not any particular hindrance, and the appearance of the latch mechanism is not particularly negatively affected.

A fourth aspect of the present disclosure further includes an annular shaped recess formed in a substantially annular shape at an outer periphery of the first support frame member, wherein, in a state in which the first support frame member and the service door are respectively attached to the peripheral wall section, an annular shaped resilient packing formed in a substantially annular shape is configured so as to engage with the annular shaped recess of the support frame member so as to resiliently retain the first support frame member in position with respect to the peripheral wall section. In this configuration, the first support frame member can be resiliently attached to the peripheral wall section of the infant accommodation space using a comparatively simple configuration. A fifth aspect of the present disclosure further includes an annular shaped recess formed in a substantially annular shape at an outer periphery of the second support frame member. In a state in which the second support frame member, the third support frame member, and the aperture window forming member have been respectively attached to the peripheral wall section, a substantially annular shaped resilient packing is configured so as to engage with the annular shaped recess of the second support frame member so as to resiliently retain a position of the second support frame member on the peripheral wall section. In this configuration, the second support frame member can be resiliently attached to the infant accommodation space using a comparatively simple configuration.

In a sixth aspect of the present disclosure, a rotation stopping projection is provided to the service door; a first engaging cutaway and a second engaging cutaway are respectively provided to the peripheral wall section; and the first support frame member is configured to be in a state swung by substantially 180° in a face-on view, such that the left and right of the first support frame member are substantially reversed, in a first state in which the rotation stopping projection is engaged with the first engaging cutaway, compared to a second state in which the rotation stopping projection is engaged with the second engaging cutaway. In this configuration, one state from out of the first state which is easy for right-handed users to handle and the second state which is easy for left-handed users to handle can be selected when attaching the first support frame member to the peripheral wall section of the infant accommodation space. Thus, it is comparatively simple to make it easier for left-handed users to handle the first support frame member, since this can be performed by selecting the second state in the case of left-handed users. In a seventh aspect of the present disclosure, the incubator is a closed incubator. This configuration enables an incubator that makes it difficult for external air to enter the infant accommodation space to be provided, since the incubator is a closed incubator.

Other objects, characteristics, and advantages of the present disclosure as described above should easily become clear from reading the following detailed description, relating to the attached drawings.

BRIEF DESCRIPTION OF THE DRAWINGS

Exemplary embodiments of the present disclosure will be described in detail based on the following figures, wherein.

DETAILED DESCRIPTION OF THE INVENTION

Explanation follows regarding an exemplary embodiment of the present disclosure applied with a closed incubator, with reference to FIG. 1 to FIG. 11, under the headings "1. Brief Explanation of Overall Incubator", "2. Explanation of Aperture Window Forming Mechanism", and "3. Explanation of Interchangeable Service Door Mechanism".

1. Brief Explanation of Overall Incubator

Figure 1:
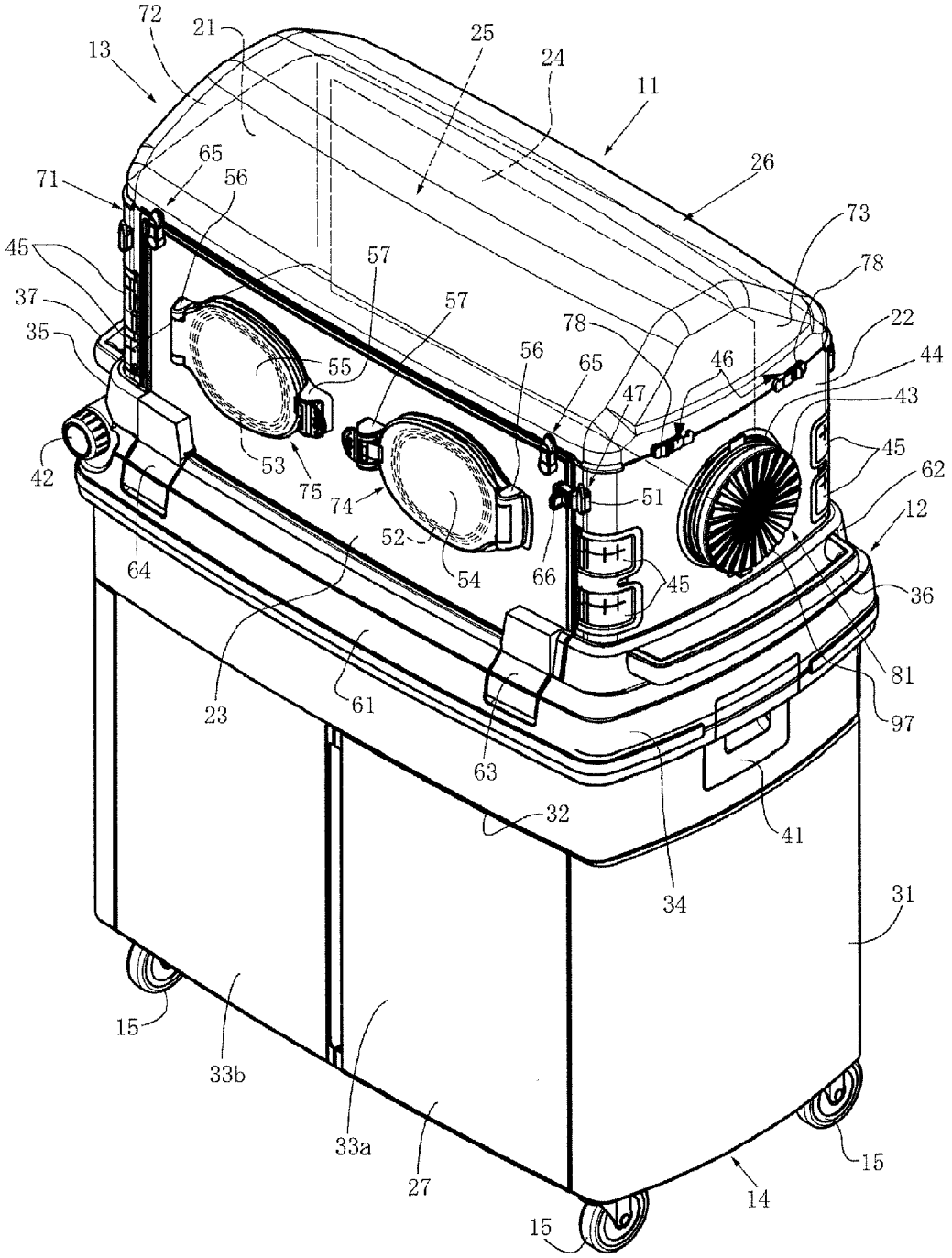
FIG. 1 is a perspective view of an incubator of an exemplary embodiment in which the present disclosure is applied to a closed incubator, in a state in which an aperture window forming mechanism has been attached to a service window of a leg side peripheral wall section.
Figure 2:
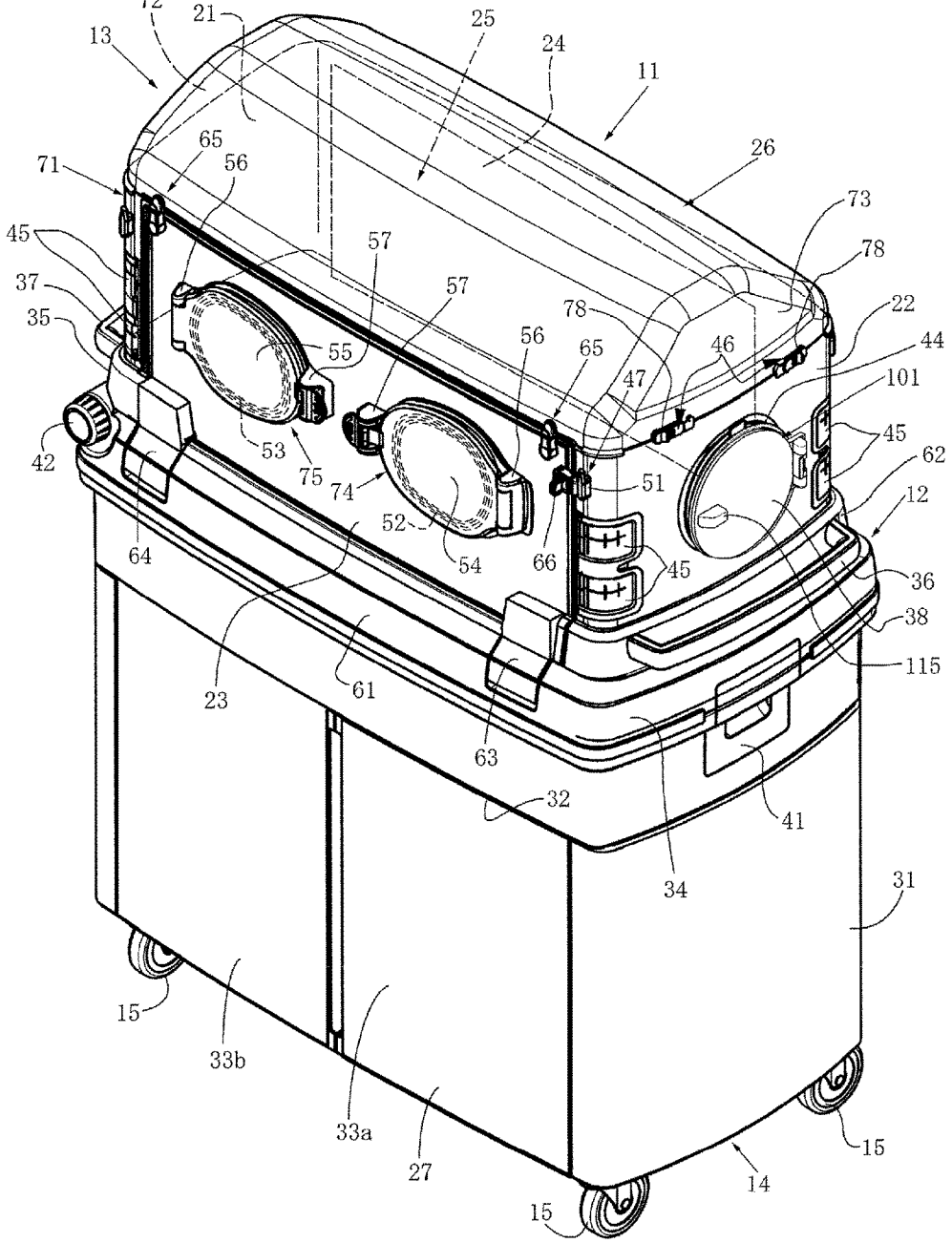
FIG. 2 is a perspective view of the incubator illustrated in FIG. 1, in a state in which an interchangeable service door mechanism has been attached to the service window of the leg side peripheral wall section.

As illustrated in FIG. 1 and FIG. 2, a closed incubator 11 respectively includes an incubator base 12 with a substantially rectangular shape (in other words, a substantially cuboid shape) or the like in plan view, an enclosure 13 standing above the incubator base 12 in a substantially cuboid shape or the like about substantially an outer periphery of the incubator base 12, and a trolley 14 serving as an incubator base support means and an incubator base support mechanism with the incubator base 12 attached and fixed to a substantially upper face thereof. The enclosure 13 is attached and fixed onto the incubator base 12 so as to be both easily attached thereto and detached therefrom. Wheels 15 used to move the incubator 11 are respectively attached to and supported by substantially the four corners on a lower face of the trolley 14. Note that, as required, the incubator base 12 may be attached and fixed to the trolley 14 so as to be both easily attached thereto and detached therefrom, or may be attached and fixed to the trolley 14 so as to be incapable of being easily detached after having been attached. For example, the incubator base 12 may be attached and fixed to the trolley 14 so as enable comparatively easy detachment therefrom using a coupling tool (not illustrated in the drawings) formed of nuts and bolts.

As illustrated in FIG. 1 and FIG. 2, the enclosure 13 respectively includes: a head side peripheral wall section (in other words, a peripheral wall section on one side out of a pair of peripheral wall sections extending in a length direction extending along the length of the enclosure 13) 21, configuring a wall section on the head side of an infant accommodated in the enclosure 13 and serving as a first fixed side peripheral wall section; a leg side peripheral wall section (in other words, a second peripheral wall section that substantially faces the first peripheral wall section 21 and is a peripheral wall section on another side out of the pair of peripheral wall sections extending in the length direction extending along the length of the enclosure 13) 22, configuring a wall section on the leg side of the infant and serving as a second fixed side peripheral wall section; a front side peripheral wall section (in other words, a third peripheral wall section that is a peripheral wall section on the right side of the infant, and is a peripheral wall section on one side out of a pair of peripheral wall sections extending along a width direction extending along the width of the enclosure 13) 23 serving as a first movable side peripheral wall section; a rear side peripheral wall section (in other words, a fourth peripheral wall section that is a peripheral wall section on the left side of the infant, and is a peripheral wall section on another side out of the pair of peripheral wall sections extending along the width direction extending along the width of the enclosure 13) 24 serving as a second movable side peripheral wall section; and a top hood 26 installed so as to cover substantially the entire upper face of an infant accommodation space 25 surrounded by the peripheral wall sections 21 to 24. Note that substantially the entire enclosure 13 may be substantially transparent, or may be substantially semi-transparent, or the like. The peripheral wall sections 21 to 24 and the top hood 26 may each be configured by a substantially transparent or substantially semi-transparent material such as a substantially transparent or substantially semi-transparent thermoplastic synthetic resin, or another substantially transparent or substantially semi-transparent synthetic resin that is a substantially transparent or substantially semi-transparent polycarbonate resin, a substantially transparent or substantially semi-transparent acrylic resin, or a substantially transparent or substantially semi-transparent ABS resin.

The trolley 14 illustrated in FIG. 1 and FIG. 2 may be substantially entirely made of a metal such as steel, and may have a substantially boxlike shape such as a substantially cuboid shape. The trolley 14 respectively includes a trolley body 31 including an opening 32 formed so as to open substantially the entire area or the like of at least one side face, such as a front side face 27, and a left and right pair of opening-closing doors 33*a*, 33*b* that are respectively attached to the trolley body 31 so as to be capable of swinging in order to open and close the opening 32 of the trolley body 31. Note that the left side opening-closing door 33*a* is attached to the trolley body 31 so as to be capable of swinging to and fro about a swing pivot point in the vicinity of a left side end on the front side of the trolley body 31. The front right side opening-closing door 33*b* is attached to the trolley body 31 so as to be capable of swinging to and fro about a swing pivot point in the vicinity of a right side end on the front side of the trolley body 31.

As illustrated in FIG. 1 and FIG. 2, a left side handle 36 and a right side handle 37 are respectively attached and fixed to outer faces in the vicinity of upper portions of a left side wall 34 and a right side wall 35 of the incubator base 12. The left side and right side handles 36, 37 may each be formed in a flat, substantially U shape, or the like. Both ends of the respective handles 36, 37 may be attached and fixed, or integrally molded, to the respective the left side wall 34 and the right side wall 35. A humidifier 41 is mounted so as to be detachably attached to a left side face of the incubator base 12, so as to be removable from the incubator base 12 by being pulled out or the like therefrom. An angle adjustment knob 42, employed to adjust a tilt angle from a head side portion to a leg side portion of a mattress tray (not illustrated in the drawings) installed inside the enclosure 13, is installed on a right side face of the incubator base 12.

The head side peripheral wall section 21 may be substantially the same size and substantially the same shape as the leg side peripheral wall section 22 illustrated in FIG. 1 and FIG. 2 (however, both peripheral wall sections are disposed in a state substantially facing each other in FIG. 1 and FIG. 2 so as to have substantially left-right symmetry). In the case illustrated in FIG. 1, a hand insertion opening 44, to which an aperture window forming member (in other words, an aperture lid) 43 including an aperture face made of cloth or the like is attached, is formed in a center portion of both the head side peripheral wall section 21 and the leg side peripheral wall section 22. In the case illustrated in FIG. 2, an interchangeable service door 38 that may be substantially transparent is attached to at least the peripheral wall section 22 so as to enable opening and closing of the hand insertion opening 44, formed in a substantially circular shape or the like at the center portion of at least the leg side peripheral wall section 22 from out of the head side peripheral wall section 21 and the leg side peripheral wall section 22. Notches (not illustrated in the drawings) are formed in a front portion and a rear portion of both the head side peripheral wall section 21 and the leg side peripheral wall section 22. Grommet members 45 are attached to the respective notches. Engagement portions of a front and rear pair of latch mechanisms 46 are respectively arranged by integral molding or the like in the vicinity of an upper end of both the head side peripheral wall section 21 and the leg side peripheral wall section 22. Latch bearing portions 51, serving as engagement portions of first latch mechanisms 47, are arranged by integral molding or the like in the vicinity of respective upper ends of a rear end of the head side peripheral wall section 21 and a front end of the leg side peripheral wall section 22. An opening (not illustrated in the drawings) for attaching auxiliary equipment such as an oxygen sensor is formed in the vicinity of the rear end and the vicinity of the upper end of the head side peripheral wall section 21.

The front side peripheral wall section 23 illustrated in FIG. 1 and FIG. 2 may be substantially the same size and substantially the same shape as the rear side peripheral wall section 24 (however, both peripheral wall sections are disposed in a state substantially facing each other in FIG. 1 and FIG. 2 so as to have substantially left-right symmetry). A left side service window 52 and a right side service window 53 are respectively arranged at a left side portion and a right side portion of both the front side peripheral wall section 23 and the rear side peripheral wall section 24. A left side service door 54 and a right side service door 55, which are respectively capable of opening and closing the left side service window 52 and the right side service window 53 and may be substantially transparent, are respectively installed at the left side portion and the right side portion of both the front side peripheral wall section 23 and the rear side peripheral wall section 24. Note that the reference numerals 56 indicate respective swing shaft support mechanisms of the left side and right side service doors 54, 55. The reference numerals 57 indicate respective latch mechanisms of the left side and right side service doors 54, 55.

As illustrated in FIG. 1 and FIG. 2, a left side hinge 63 and a right side hinge 64 are installed, so as to be capable of swinging to and fro (in other words, capable of swinging outward and capable of swinging back inward) about swing shafts (not illustrated in the drawings), in the vicinity of both left and right sides in the vicinity of an upper end of both a front side section 61 and a rear side section 62 of the incubator base 12. A left and right pair of second latch mechanisms 65, which engage with a lower end on both the front side and rear side of the top hood 26 when the peripheral wall sections 23, 24 are in a closed state, are installed on both the front side peripheral wall section 23 and the rear side peripheral wall section 24. Latch levers 66, each serving as an engaging portion of the first latch mechanisms 47, are respectively installed in the vicinity of left side ends and the vicinity of upper side ends of the front side peripheral wall section 23 and the rear side peripheral wall section 24, respectively. When opening the front side and rear side peripheral wall sections 23, 24, the front side and rear side peripheral wall sections 23, 24 may be opened after unlatching these latch levers 66 from the latch bearing portions 51 serving as engagement portions by a shift-out operation of the latch levers 66.

As illustrated in FIG. 1 and FIG. 2, the top hood 26 may be formed in a substantially truncated rectangular pyramid shape or the like, and a lower face thereof may be a hollow body open over the entire area. Note that a peripheral frame section 71, which is substantially rectangular (in other words, a substantially angular tube shape with both an upper face and a lower face open over substantially the entire area) or the like in plan view, is configured by the head side peripheral wall section 21, the leg side peripheral wall section 22, the front side peripheral wall section 23, and the rear side peripheral wall section 24. The enclosure 13 is configured by the peripheral frame section 71, and the top hood 26 that is capable of selectively covering the upper face opening of the peripheral frame section 71. Engaging portions 78 of the front and rear pair of latch mechanisms 46 are respectively installed at a front portion and a rear portion of both the head side end and the leg side end of the top hood 26.

The peripheral frame section 71, with both its upper end and lower end open over substantially the entire area, is configured by the front side peripheral wall section 23, the head side peripheral wall section 21, the rear side peripheral wall section 24, and the leg side peripheral wall section 22 illustrated in FIG. 1 and FIG. 2. Substantially the entire area of the upper end opening of the peripheral frame section 71 is covered by the top hood 26. A left side lower end and a right side lower end of the top hood 26 are respectively attached and fixed to the head side peripheral wall section 21 and the leg side peripheral wall section 22 by the respective front and rear pairs of latch mechanisms 46. A head side wall section 72 and a leg side wall section 73 of the top hood 26 are thereby respectively coupled to the head side peripheral wall section 21 and the leg side peripheral wall section 22 of the peripheral frame section 71. Respective lower ends of the head side wall section 72 and leg side wall section 73 of the top hood 26 may be attached and fixed to the respective upper ends of the head side and leg side peripheral wall sections 21, 22 of the peripheral frame section 71 in a state capable of being detached therefrom by the respective front and rear pairs of latch mechanisms 46 on the head side and the leg side.

The second latch mechanisms 65 are respectively installed on both the front side peripheral wall section 23 and the rear side peripheral wall section 24 in order to reliably retain both the front side peripheral wall section 23 and the rear side peripheral wall section 24 in the swung back position illustrated in FIG. 1 and FIG. 2. When the second latch mechanisms 65 have been placed in a state other than a substantially upright state illustrated in FIG. 1 (such as a substantially hanging state or a substantially sideways state), the respective second latch mechanisms 65 can be placed in the substantially upright state by swinging the respective front side and rear side peripheral wall sections 23, 24 from an open position to a closed position, and then swinging the respective second latch mechanisms 65. The front side and rear side peripheral wall sections 23, 24 can be reliably and simply locked in the closed position by this swinging operation. This locking can be released by performing the reverse operation to that described above. Note that when it is desirable to open the front side and rear side peripheral wall sections 23, 24, the respective front side and rear side peripheral wall sections 23, 24 may be swung out after releasing the locking as described above, then removing the latch levers 66 from the latch bearing portions 51.

As illustrated in FIG. 1 and FIG. 2, a left side service door mechanism 74 and a right side service door mechanism 75 are respectively installed on both the front side peripheral wall section 23 and the rear side peripheral wall section 24. Note that the right side service door mechanism 75 of the front side peripheral wall section 23 and the left side service door mechanism 74 of the front side peripheral wall section 23 may have substantially left-right symmetry. The left side service door mechanism of the rear side peripheral wall section 24 and the right side service door mechanism of the rear side peripheral wall section 24 may also have substantially left-right symmetry. The left side service door mechanism of the rear side peripheral wall section 24 and the right side service door mechanism 75 of the front side peripheral wall section 23 may have substantially front-rear symmetry. The right side service door mechanism of the rear side peripheral wall section 24 and the left side service door mechanism 74 of the front side peripheral wall section 23 may also have substantially front-rear symmetry.

2. Explanation of Aperture Window Forming Mechanism

Figure 3:
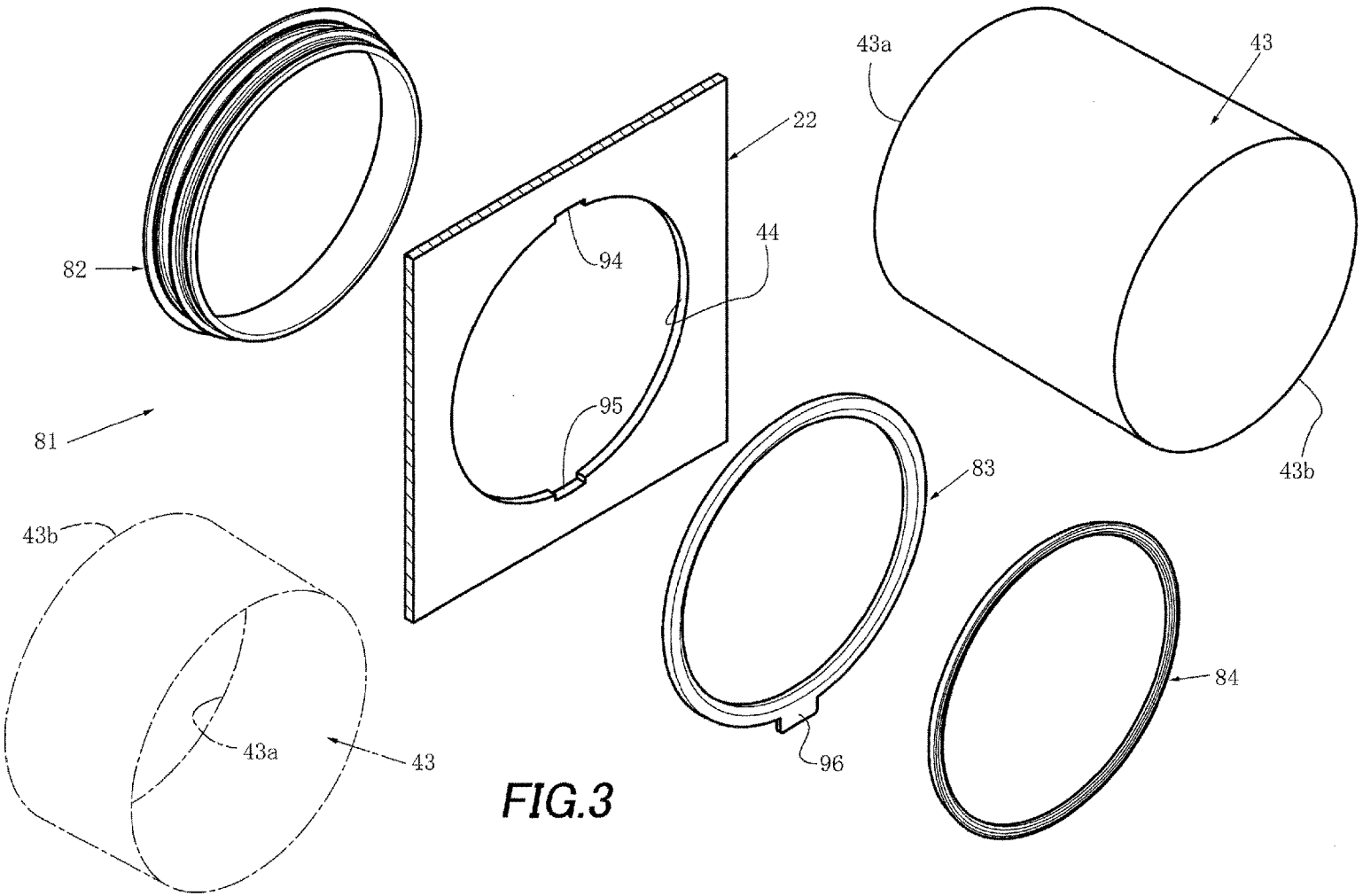
FIG. 3 is an exploded perspective view of the aperture window forming mechanism illustrated in FIG. 1.
Figure 4:
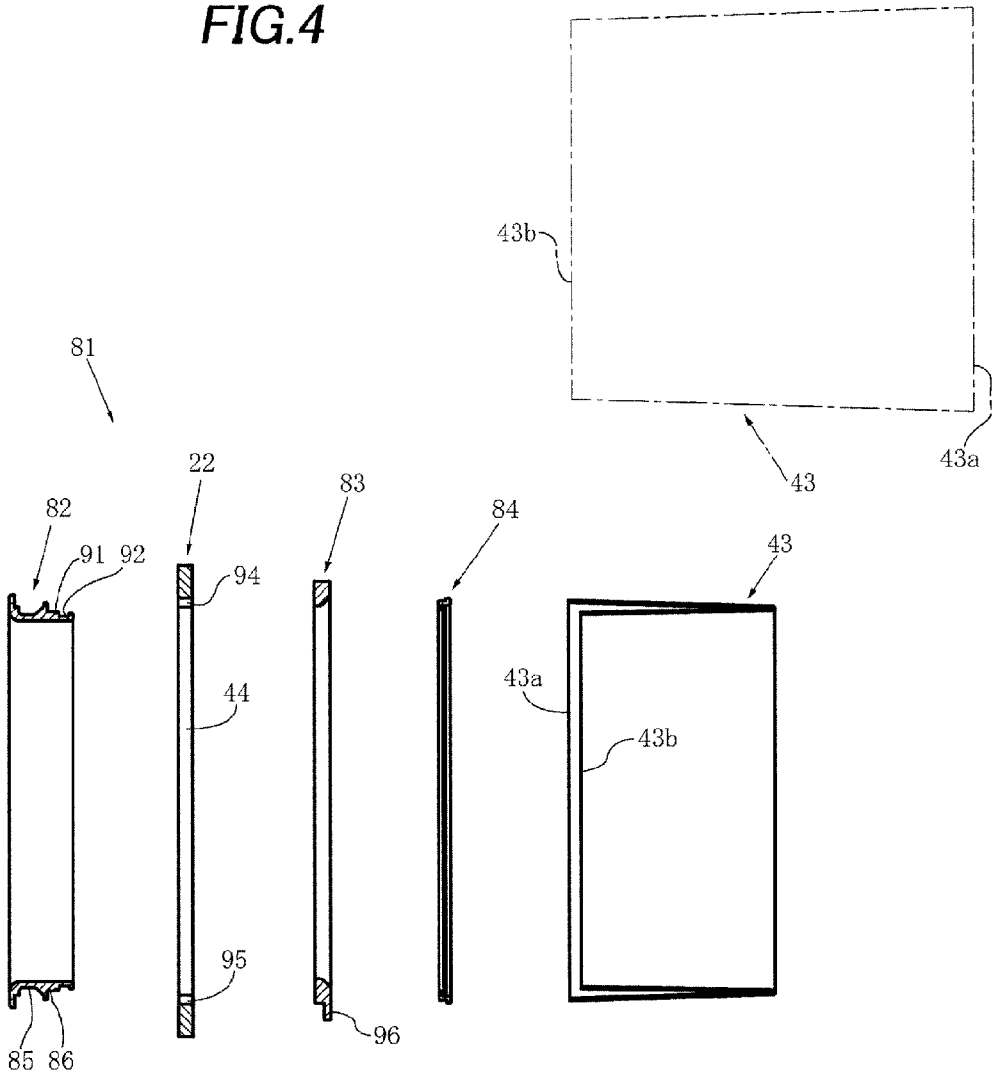
FIG. 4 is a vertical cross-section of the aperture window forming mechanism illustrated in FIG. 3.
Figure 5:
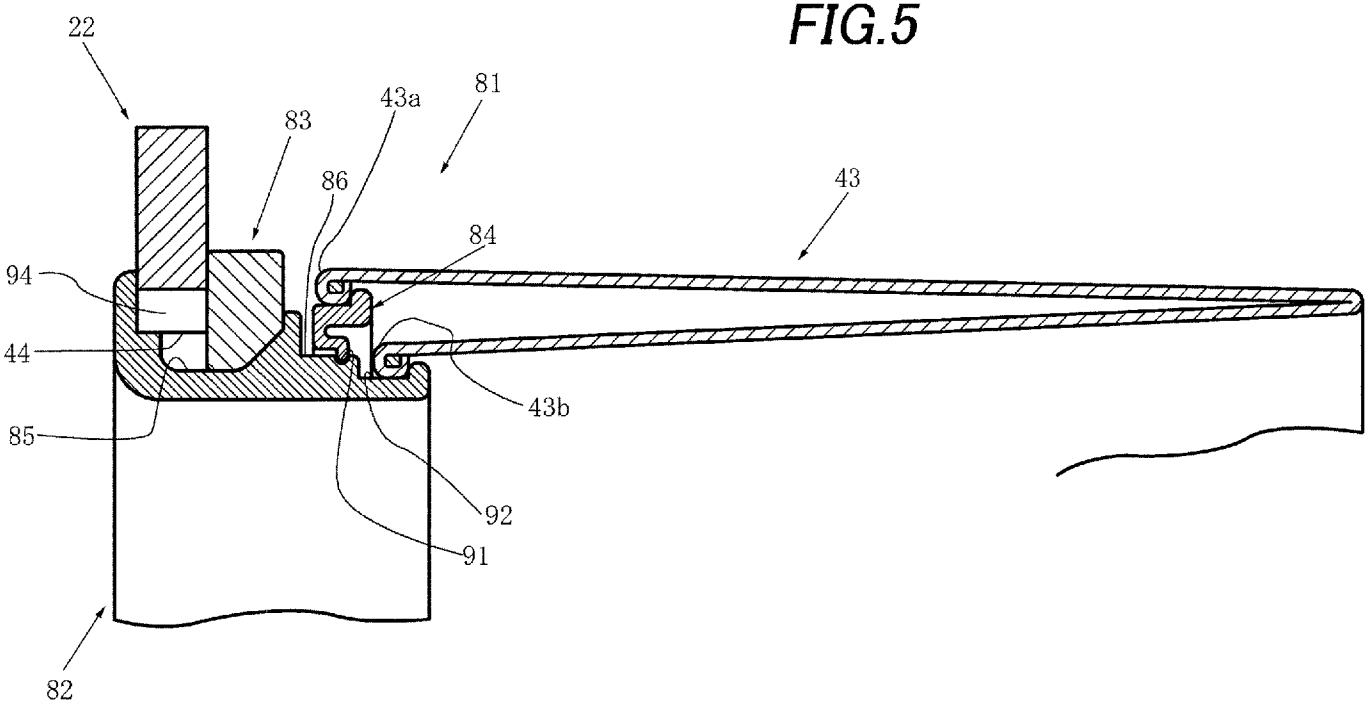
FIG. 5 is a partial cross-section of the aperture window forming mechanism illustrated in FIG. 1, in a state in which the aperture window is open.

As illustrated in FIG. 1, etc., the substantially circular shaped hand insertion opening 44 is respectively formed in both the head side peripheral wall section 21 and the leg side peripheral wall section 22 of the enclosure 13. As illustrated in FIG. 3 to FIG. 5, an aperture window forming mechanism 81 installed in the vicinity of each hand insertion opening 44 includes: a substantially circular annular shaped support frame member 82 that engages with the respective peripheral wall section 21, 22 from an inside face of the respective head side peripheral wall section 21 or leg side peripheral wall section 22; substantially circular annular shaped resilient packing 83 that is fitted between the respective peripheral wall section 21, 22 and the support frame member 82 from an outside face of the respective head side peripheral wall section 21 or leg side peripheral wall section 22; a substantially circular annular shaped support frame member 84 that is fitted together with the respective support frame member 82 from the outside face of the respective head side peripheral wall section 21 or leg side peripheral wall section 22 so as to be adjacent to an outside face of the respective resilient packing 83; and an aperture window forming member 43 that is fitted together with the respective peripheral wall section 21, 22 from the outside face of the head side peripheral wall section 21 or leg side peripheral wall section 22 so as to be adjacent to an outside face of the respective support frame member 84.

As illustrated in FIG. 4, etc., a first ring shaped recess 85 that enables the respective peripheral wall section 21, 22 and the resilient packing 83 to engage with each other, a substantially ring shaped flat face 86 that is adjacent to the first ring shaped recess 85, a narrow width second ring shaped recess 91 that is formed to the flat face 86, and a third ring shaped recess 92 that is adjacent to the flat face 86, are respectively formed around an outer periphery of the support frame member 82, from an inner end to an outer end of the outer periphery of the support frame member 82. Engagement cutaways 94, 95 that are capable of engaging with a rotation stopping projection 93 of the interchangeable service door 38 are respectively arranged at an upper end and a lower end in the vicinity of an outer periphery of the hand insertion opening 44 of the respective peripheral wall section 21, 22. A knob 96, which a user can grip with their fingers when detaching the resilient packing 83 from the respective peripheral wall section 21, 22 and the support frame member 82 in a state in which the resilient packing 83 has been wedged between the respective peripheral wall section 21, 22 and the support frame member 82 as illustrated in FIG. 5, projects outward at the outer periphery of the resilient packing 83 so as to be distanced from the center of the resilient packing 83. The support frame member 82 and the support frame member 84 may each be configured of a substantially transparent, substantially semi-transparent, or substantially opaque material, such as another substantially transparent, substantially semi-transparent, or substantially opaque synthetic resin that is a substantially transparent, substantially semi-transparent, or substantially opaque polycarbonate resin, a substantially transparent, substantially semi-transparent, or substantially opaque acrylic resin, or a substantially transparent, substantially semi-transparent, or substantially opaque ABS resin.

The attachment operation described below may be performed when attaching the aperture window forming member 43 illustrated by solid lines in FIG. 3 and illustrated by an intermittent line in FIG. 4 to the leg side peripheral wall section 22 as illustrated in FIG. 1. Note that the aperture window forming member 43 may have a substantially circular tube shape, but is preferably configured so as to have a slightly circular truncated cone shape overall, as illustrated by solid lines in FIG. 3 and illustrated by an intermittent line in FIG. 4. A resilient, substantially ring shaped cord, such as a rubber band, may be respectively attached as required to both ends (in other words, openings) 43*a*, 43*b* of the aperture window forming member 43. In the attachment operation, first, the aperture window forming member 43 illustrated by solid lines in FIG. 3 and an intermittent line in FIG. 4 may be folded back on itself along a direction substantially orthogonal to substantially the axial center direction thereof, as illustrated by intermittent lines in FIG. 3 and illustrated by solid lines in FIG. 4. The large diameter end 43*a* of the aperture window forming member 43 may then be engaged with an outer periphery of the support frame member 84, and the small diameter end 43*b* of the aperture window forming member 43 may be engaged with the third ring shaped recess 92 of the support frame member 82. The reverse operation to the attachment operation described above may be performed when detaching the aperture window forming member 43 illustrated in FIG. 1 from the leg side peripheral wall section 22. Note that attachment screws, adhesive, or the like do not particularly need to be used when respectively attaching the aperture window forming member 43, the support frame member 82, the resilient packing 83, and the support frame member 84 to the leg side peripheral wall section 22, and so the detachment operation is comparatively simple.

In the incubator 11 illustrated in FIG. 1 and FIG. 3 to FIG. 5, when a user is treating an infant accommodated inside the incubator 11 in some way, the user may first swing out the support frame member 84 by hand or the like. In this manner, an aperture window 97 formed by the aperture window forming member 43 opens from a substantially closed state to a substantially open state. This enables the user to treat the infant by inserting their hand and arm into the enclosure 13 through the aperture window 97. The user is also able to insert a tube such as a resuscitation equipment oxygen supply tube (not illustrated in the drawings) into the enclosure 13 through the aperture window 97.

3. Explanation of Interchangeable Service Door Mechanism

Figure 6:
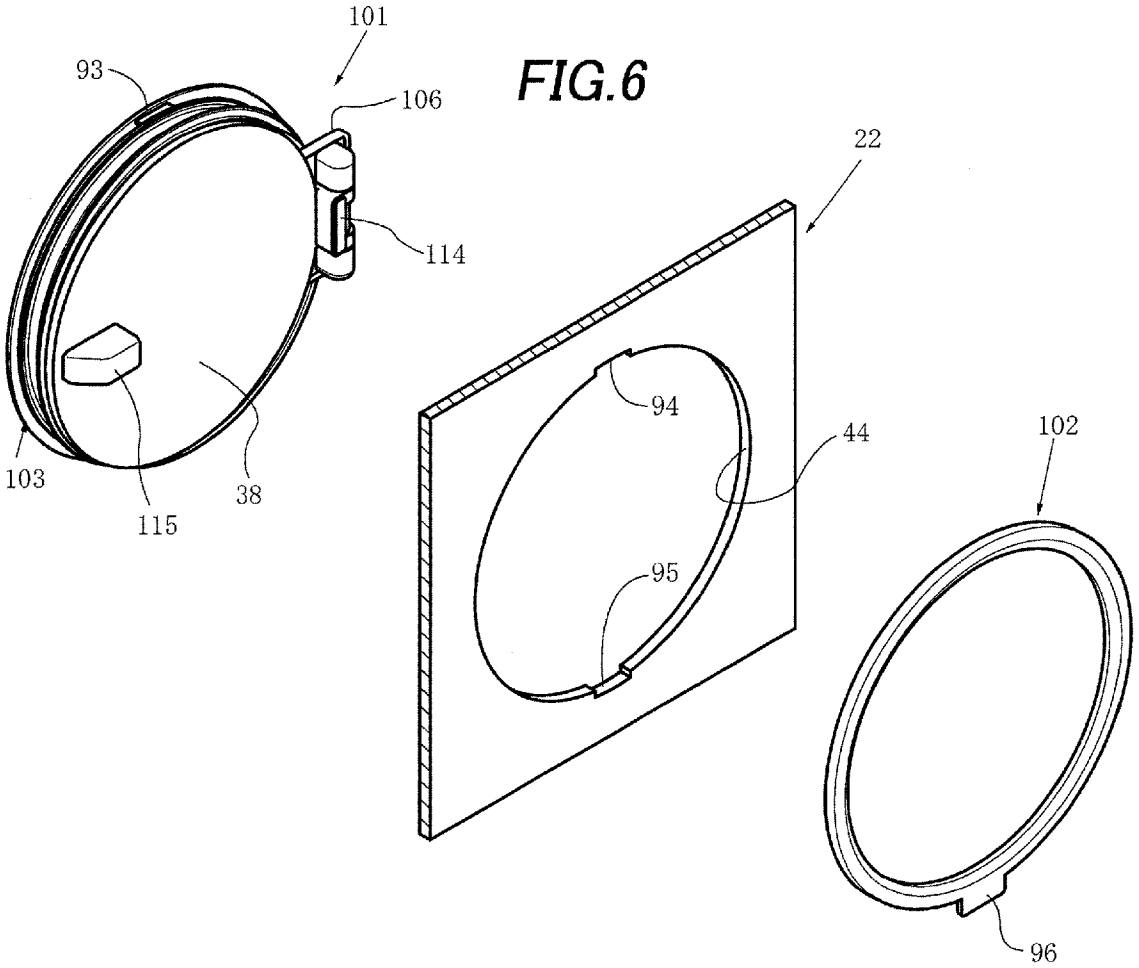
FIG. 6 is an exploded perspective view of the interchangeable service door mechanism illustrated in FIG. 2, illustrating a state in which the interchangeable service door mechanism has been detached from the service window.

An interchangeable service door mechanism 101 illustrated in FIG. 2 and FIG. 6, etc. may be installed in the vicinity of the hand insertion opening 44 instead of the aperture window forming mechanism 81 illustrated in FIG. 1, etc. The interchangeable service door mechanism 101 includes: resilient packing 102 that may be the same component as the resilient packing 83 of the aperture window forming mechanism 81, or be a component with substantially the same configuration as the resilient packing 83; a support frame member 103 that is installed on the respective head side peripheral wall section 21 or leg side peripheral wall section 22 from the inside face thereof and engages with the respective peripheral wall section 21, 22; and the service door 38 that is axially supported by the support frame member 103 through a swing support shaft 104 so as to be capable of swinging. Note that the same hand insertion opening 44 may be formed in the head side and leg side peripheral wall sections 21, 22 illustrated as a horizontal cross-section in FIG. 7, etc. as that applied to the head side and leg side peripheral wall sections 21, 22 illustrated as a vertical cross-section in FIG. 4. The resilient packing 102 thereby includes a knob 96, similarly to the resilient packing 83 illustrated in FIG. 4, etc. The first engaging cutaway 94 and the second engaging cutaway 95, which the rotation stopping projection 93 of the interchangeable service door 38 can selectively engage with, are respectively arranged at an upper end and a lower end in the vicinity of the outer periphery of the hand insertion opening 44 of the respective peripheral wall section 21, 22.

Figure 7:
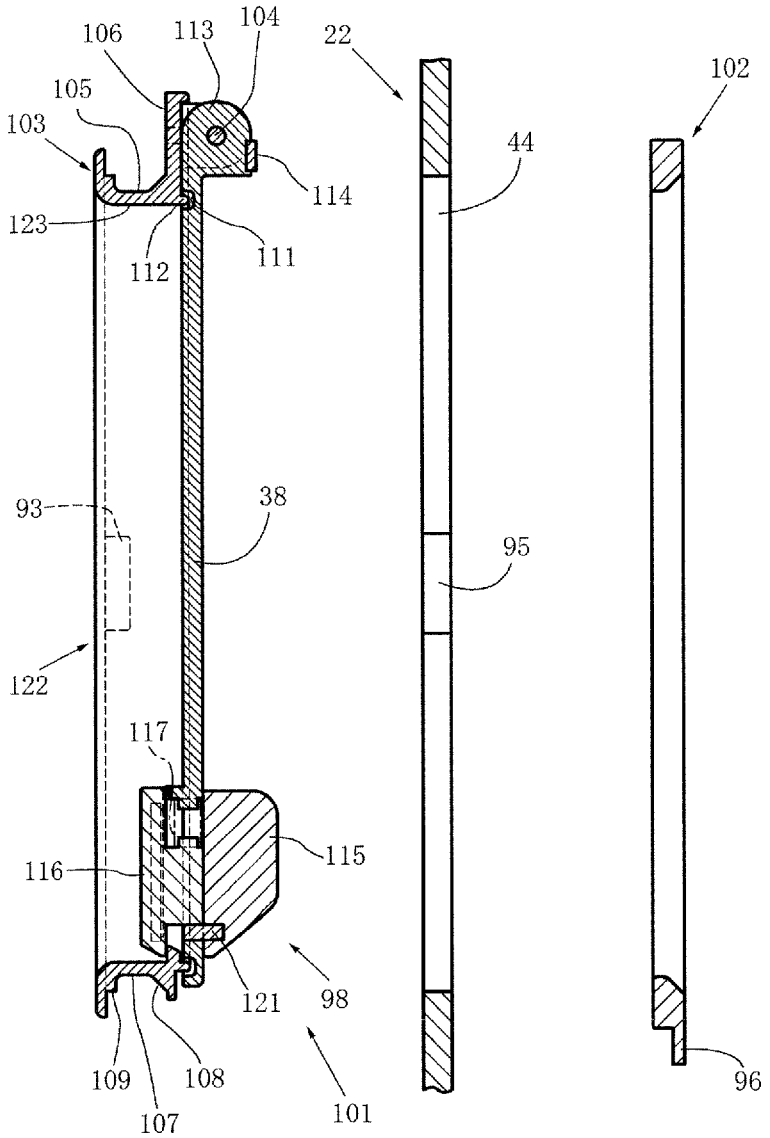
FIG. 7 is a horizontal cross-section of the interchangeable service door mechanism illustrated in FIG. 6.
Figure 10:
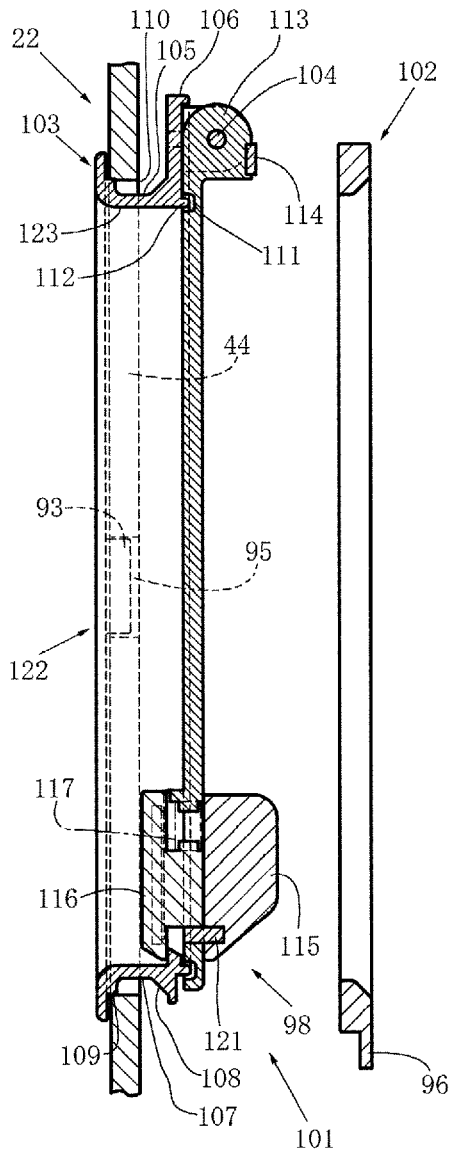
FIG. 10 is a horizontal cross-section illustrating a third process in which the interchangeable service door mechanism illustrated in FIG. 7 is attached to the leg side peripheral wall section.

The support frame member 103 illustrated in FIG. 7, etc. includes a ring shaped recess 105 that may be substantially the same shape as the first ring shaped recess 85 of the support frame member 82 illustrated in FIG. 4. A protrusion 106 that projects out in a substantially horizontal direction is continuously provided to the support frame member 103. The service door 38 is axially supported at the protrusion 106 by the swing support shaft 104 so as to be capable of swinging. A groove 111 with a substantially annular shape, such as a substantially circular annular shape, is formed in an inner face of the service door 38. A ridge 112 with a substantially annular shape, such as a substantially circular annular shape, corresponding to the annular shaped groove 111 is formed to an outer face of the support frame member 103. Thus, the annular shaped ridge 112 substantially engages with the annular shaped groove 111 in a state in which the service door 38 is closed as illustrated in FIG. 10, etc., thereby enabling an airtight seal of the hand insertion opening 44 to be substantially maintained. A cushioning plate 114, configured from a resilient body such as rubber and formed in a substantially rectangular shape or the like, is installed on an axially supported portion 113 of the service door 38. Note that the cushioning plate 114 serving as a cushioning means is installed so as to face outward when the service door 38 is in the closed state.

As illustrated in FIG. 7, etc., a latch release knob 115 of a latch mechanism 98 for latching the service door 38 is attached to a leading end side of the service door 38 so as to be capable of moving to and fro substantially along a straight line at the outside of the service door 38. A latch hook member 116 is integrally joined to an inner face of the latch release knob 115. The latch hook member 116 is attached to the service door 38 so as to be capable of moving to and fro in a straight line substantially along the horizontal direction. The latch hook member 116 is spring-biased in substantially the horizontal direction toward the opposite side to the swing support shaft 104 side by a spring means 117 such as a coil spring. A buffering stopper 121, for preventing the latch hook member 116 from violently contacting the service door 38 due to the spring means 117, is attached to the latch release knob 115. Note that the buffering stopper 121 may be configured from a resilient member such as rubber in a column shape such as a substantially circular column shape. The service door 38, the support frame member 103, the latch release knob 115, and the latch hook member 116 may each be configured of a substantially transparent, substantially semi-transparent, or substantially opaque material, such as another substantially transparent, substantially semi-transparent, or substantially opaque synthetic material that is a substantially transparent, substantially semi-transparent, or substantially opaque polycarbonate resin, a substantially transparent, substantially semi-transparent, or substantially opaque acrylic resin, or a substantially transparent, substantially semi-transparent, or substantially opaque ABS resin.

Figure 8:
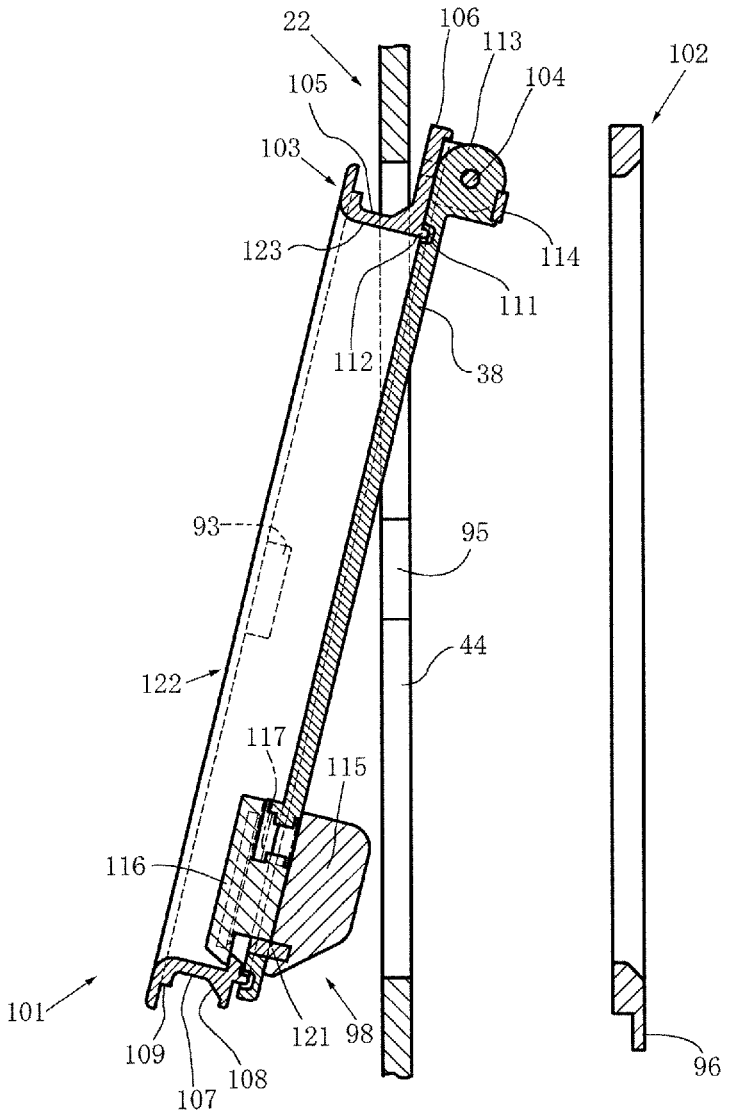
FIG. 8 is a horizontal cross-section illustrating a first process in which the interchangeable service door mechanism illustrated in FIG. 7 is attached to a leg side peripheral wall section.
Figure 9:
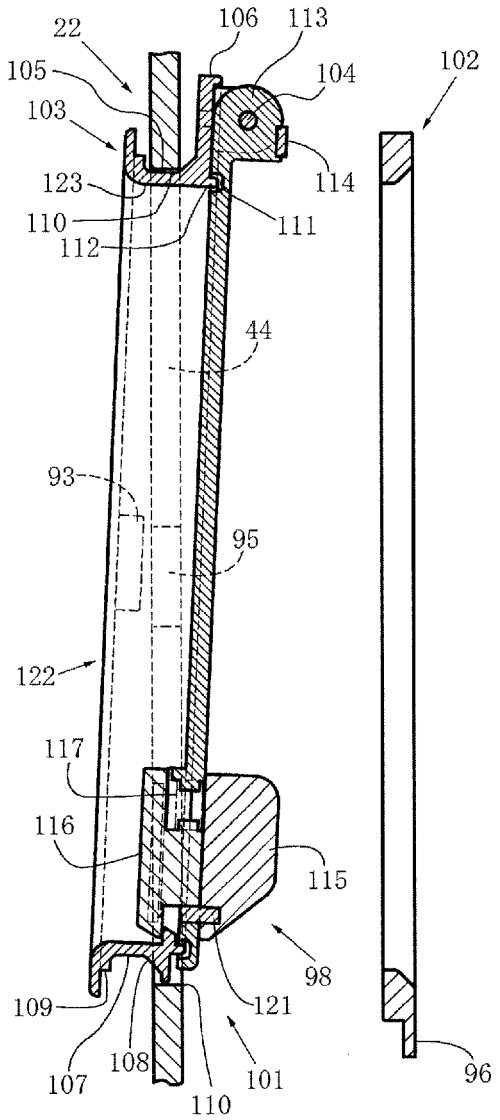
FIG. 9 is a horizontal cross-section illustrating a second process in which the interchangeable service door mechanism illustrated in FIG. 7 is attached to the leg side peripheral wall section.
Figure 11:
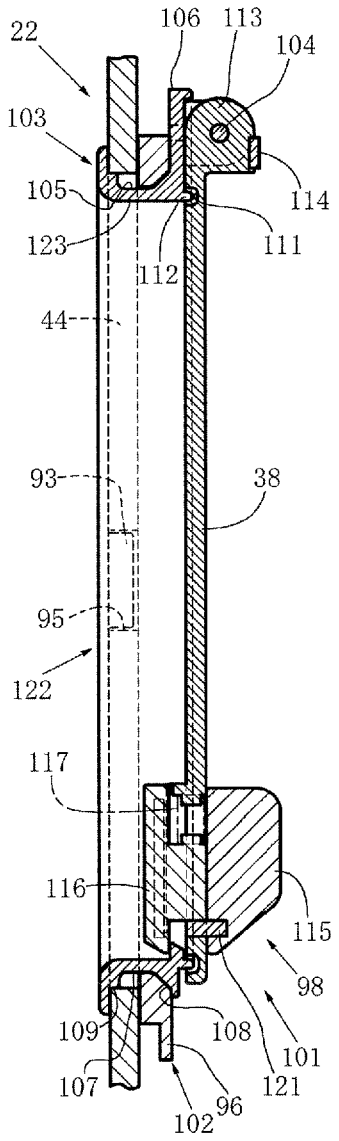
FIG. 11 is a horizontal cross-section illustrating a fourth process in which the interchangeable service door mechanism illustrated in FIG. 7 is attached to the leg side peripheral wall section.

As illustrated in FIG. 7 to FIG. 11, attachment of an assembled body 122, configured of the service door 38 and the support frame member 103, to the leg side peripheral wall section 22 may be performed according to the sequence described in (a) to (e) below:

(a) as illustrated in FIG. 7, the assembled body 122 configured of the service door 38 and the support frame member 103 is brought inside the leg side peripheral wall section 22;

(b) as illustrated in FIG. 8, the assembled body 122 is tilted, and the protrusion 106 side thereof is passed through the hand insertion opening 44 to outside the peripheral wall section 22;

(c) as illustrated in FIG. 9, an edge of the hand insertion opening 44 is positioned at a smallest outer diameter portion 107 of the ring shaped recess 105 of the support frame member 103, and an outer portion 108 of the ring shaped recess 105 of the support frame member 103 is then moved in sequence from the protrusion 106 side to outside the hand insertion opening 44;

(d) as illustrated in FIG. 10, the outer portion 108 of the ring shaped recess 105 of the support frame member 103 is taken out from the hand insertion opening 44, after which a step portion 109 formed inside the ring shaped recess 105 is engaged with an edge 110 of the hand insertion opening 44; and (e) as illustrated in FIG. 11, the resilient packing 102 is engaged with the ring shaped recess 105, such that the resilient packing 102 is wedged between the outer portion 108 of the ring shaped recess 105 and an outer face of the peripheral wall section 22, thereby attaching the support frame member 103 to the edge 110 of the hand insertion opening 44 of the peripheral wall section 22 in a stable state.

The reverse operation to the attachment operation described in (a) to (e) above may be performed when detaching the assembled body 122 illustrated in FIG. 2 from the leg side peripheral wall section 22. Note that attachment screws, adhesive, and the like are not particularly required when attaching the service door 38 and the support frame member 103 to the leg side peripheral wall section 22, such that the detachment operation is comparatively simple.

As illustrated in FIG. 6, the first engaging cutaway 94 and the second engaging cutaway 95 are respectively arranged at the upper end and the lower end in the vicinity of the outer periphery of the hand insertion opening 44 of the respective peripheral wall section 21, 22. This enables the rotation stopping projection 93 of the interchangeable service door 38 to be selectively engaged with either the first engaging cutaway 94 or the second engaging cutaway 95. Note that in FIG. 2, the interchangeable service door 38 is stopped from rotating with respect to the leg side peripheral wall section 22 due to the rotation stopping projection 93 being engaged with the first engaging cutaway 94. In order to open and close the interchangeable service door 38 in a first state illustrated in FIG. 2 that is generally appropriate for right-handed users, a right-handed user can comparatively easily open and close the interchangeable service door 38 using their dominant hand. When opening and closing the interchangeable service door 38 with respect to the leg side peripheral wall section 22 by engaging the rotation stopping projection 93 with the second engaging cutaway 95 in a second state that is the left-right reverse of the first state illustrated in FIG. 2, this being generally appropriate for left-handed users, a left-handed user can comparatively easily open and close the interchangeable service door 38 using their dominant hand.

In the incubator 11 illustrated in FIG. 2, etc., when a user is treating in some way an infant accommodated inside the incubator 11, the user may swing the service door 38 out after first releasing the latched state of the service door 38 by operating the latch release knob 115 of the service door 38 by hand or the like. Specifically, the latched state of the service door 38 is released when the user moves the latch release knob 115 illustrated in FIG. 11 from left to right. The service door 38 is thereby swung out in the counterclockwise direction illustrated in FIG. 10 with the swing support shaft 104 as a swing pivot point, under resilient biasing force from a spring means such as a twisted coil spring (not illustrated in the drawings) assembled to the assembled body 122. This swinging out can be performed over approximately 180° until the cushioning plate 114 of the service door 38 abuts the protrusion 106 of the support frame member 103, thereby enabling a central opening 123 of the support frame member 103 to be substantially fully opened. When the user swings back the service door 38, the service door 38 is swung in the reverse direction to that when being swung out, thereby enabling the service door 38 to be returned to the latched state illustrated in FIG. 10.

An exemplary embodiment of the present disclosure has been explained in detail above; however, the present disclosure is not limited to this exemplary embodiment, and various modifications and improvements are possible based on the spirit of the disclosure as recited in the claims.

For example, the present disclosure is applied to a closed incubator in the above-described exemplary embodiment. However, the present disclosure is not only applicable to a closed incubator, and may also be applied to other types of incubator, such as a closed incubator that may be employed as an open incubator.

In the above-described exemplary embodiment, the hand insertion opening 44 is configured in a substantially circular shape and a portion of the support frame member 82 excluding the axially supported portion 113 (in other words, a main body) is also configured in a substantially circular shape. However, the hand insertion opening 44 and the main body may each be configured in another shape, such as a substantially elliptical shape, or a substantially oval shape.

In the above-described exemplary embodiment, the groove 111 formed in the inside face of the service door 38 is formed in a substantially complete annular shape on the inside face of the service door 38, and the ridge 112 formed on the outside face of the support frame member 103 is also configured in a substantially complete annular shape so as to engage with the substantially annular shaped groove 111. However, in some cases, the groove 111 may include some intermittent portions without being substantially completely annular shaped, and the ridge 112 may also include some cutaway portions corresponding to the intermittent portions and so on.

What is claimed is:

1. An incubator comprising:

a hand insertion opening formed in a peripheral wall defining an infant accommodation space;

a service door configured to close the hand insertion opening;

a support frame member comprising a first outer periphery section and a second outer periphery section arranged in a thickness direction of the support frame member, the first outer periphery section being attached around an inner periphery of the hand insertion opening to secure the support frame member to the peripheral wall;

a hinge mechanism secured to the support frame member, the hinge mechanism being attached to the service door to allow the service door to swing around the hinge mechanism between a first position where the service door closes the hand insertion opening and a second position where the service door opens the hand insertion opening;

an aperture window forming member configured to attach around the second outer periphery section of the support frame member, the aperture window forming member and the service door being alternatively attached to the support frame member; and a latch mechanism provided to the service door, the latch mechanism comprising a latch hook and latch release knob, the latch hook being engageable with the support frame member to keep the service door in the first position, the latch release knob operable to move the latch hook to engage with or disengage from the support frame member, wherein the latch hook and latch release knob are positioned with respect to the service door so that the latch hook and latch release knob do not extend beyond a circumferential edge of the service door when the service door is in the first position.

2. The incubator of claim 1, wherein an inner periphery of the support frame member defines an opening through which an interior of the incubator is accessible.

3. The incubator of claim 1, further comprising a spacer attached around the first outer periphery section to secure the support frame member to the peripheral wall.

4. The incubator of claim 1, further comprising an elastic spacer attached around the first outer periphery section to secure the support frame member to the peripheral wall.

5. The incubator of claim 1, wherein the service door comprises a rotation stopping projection formed in an outer periphery of the service door, the hand insertion opening formed in the peripheral wall comprises a first engaging cutaway and a second engaging cutaway formed in the the inner periphery of the hand insertion opening at a 180 degree angular interval, each of the first and second engaging cutaways being configured to engage with the rotation stopping projection and the service door is placed in the hand insertion opening with the rotation stopping projection being engaged with either the first or second engaging cutaway.

6. The incubator of claim 1, wherein the incubator is a closed incubator.

* * * * *